US005108341A

United States Patent [19]

DeSmet

[11] Patent Number: 5,108,341

[45] Date of Patent: Apr. 28, 1992

[54] TOY WHICH MOVES IN SYNCHRONIZATION WITH AN AUDIO SOURCE

[75] Inventor: Eric DeSmet, Sint Niklaas, Belgium

[73] Assignee: View-Master Ideal Group, Inc., New York, N.Y.

[21] Appl. No.: 394,282

[22] Filed: Aug. 14, 1989

Related U.S. Application Data

[63] Continuation of Ser. No. 868,659, May 28, 1986, abandoned.

[51] Int. Cl.[5] ..... A63H 3/28

[52] U.S. Cl. ..... 446/299; 446/300; 446/301

[58] Field of Search ..... 446/297-301; 352/87; 40/416, 455, 457, 463

[56] References Cited

U.S. PATENT DOCUMENTS

| | | | |
|---|---|---|---|
| 3,199,248 | 8/1965 | Suzuki . | |
| 3,204,358 | 9/1965 | Jones | 40/457 |
| 3,264,778 | 9/1966 | Ryan . | |
| 3,271,898 | 9/1966 | Glass et al. | 446/301 |
| 3,287,849 | 11/1966 | Weiss . | |
| 3,427,745 | 2/1969 | Duffy, Jr. . | |
| 3,495,351 | 2/1970 | Bear et al. | 446/299 |
| 3,662,374 | 5/1972 | Harrison, III et al. . | |
| 3,685,200 | 8/1972 | Noll . | |
| 3,912,694 | 10/1975 | Chiappe et al. . | |
| 3,973,840 | 8/1976 | Jacobs et al. . | |
| 4,207,704 | 6/1980 | Akiyama . | |
| 4,231,184 | 10/1980 | Corris et al. | 446/299 |
| 4,249,338 | 2/1981 | Wexler | 446/303 |
| 4,318,245 | 3/1982 | Stowell et al. | 446/484 |
| 4,521,205 | 6/1985 | Spector . | |
| 4,608,525 | 8/1986 | Mori et al. . | |
| 4,660,033 | 4/1987 | Brandt | 446/301 |
| 4,665,640 | 5/1987 | Forsse et al. | 40/457 |
| 4,717,364 | 1/1988 | Furukawa | 446/175 |
| 4,775,352 | 10/1988 | Curran et al. | 446/299 |

FOREIGN PATENT DOCUMENTS

| | | |
|---|---|---|
| 717257 | 9/1965 | Canada . |
| 86301920.4 | 3/1986 | European Pat. Off. . |
| 2335901 | 7/1977 | France . |

OTHER PUBLICATIONS

"Worlds of Wonder" Prospectus, Jun. 20, 1986, pp. 7 and 14.

*Primary Examiner*—Lee S. Cohen
*Assistant Examiner*—John P. Lacyk
*Attorney, Agent, or Firm*—Panitch Schwarze Jacobs & Nadel

[57] ABSTRACT

The present invention comprises a mechanism for synchronizing movement of a portion of a bird or other toy character with an audio source. In one form, a tape deck is included within the body of the bird. The tape deck plays cassettes which are prerecorded to provide audio on one channel and data on another channel. The audio is amplified and delivered to a speaker in the bird so that the bird can speak or sing as desired. Typically, the bird includes more than one movable part. The data is decoded and, in response to the data, drive mechanisms are operated to move desired parts of the bird. The data channel also carries address information in the event one or more optional satellite characters are used. Movement of the satellite characters is synchronized to the audio and to the master character.

16 Claims, 7 Drawing Sheets

DATA FORMAT EXAMPLES

| NO. | START | $\bar{A}/D$ | CH. ON D7 | MUTE D6 | A5 D5 | A4 D4 | A3 D3 | A2 D2 | A1 D1 | AØ DØ | P | STOP |
|---|---|---|---|---|---|---|---|---|---|---|---|---|
| 1 | / | / | / | / | / | / | / | / | / | / | / | / |
| 2 | 0 | 0 | 0 | 1 | 0 | 0 | 0 | 0 | 0 | 1 | 1 | 0 |
| 3 | 0 | 0 | 0 | 0 | 0 | 0 | 0 | 0 | 0 | 1 | 0 | 0 |
| 4 | 0 | 1 | 0 | 0 | 0 | 0 | 1 | 1 | 1 | 1 | 0 | 0 |
| 5 | 0 | 1 | 0 | 0 | 0 | 0 | 0 | 1 | 0 | 1 | 0 | 0 |
| 6 | 0 | 1 | 0 | 0 | 0 | 0 | 0 | 1 | 0 | 1 | 0 | 1 |
| 7 | 0 | 1 | 0 | 0 | 0 | 0 | 0 | 1 | 0 | 1 | 1 | 0 |
| 8 | 0 | 1 | 0 | 0 | 0 | 0 | 0 | 0 | 1 | 0 | 1 | 0 |
| 9 | 0 | 0 | 1 | 1 | 0 | 0 | 0 | 0 | 0 | 1 | 0 | 0 |

INPUTS

| $\overline{POR}$ | CDS |
|---|---|
| 0 | 0 |
| 1 | 0 |
| 1 | 0 |
| 1 | 0 |
| 1 | 0 |
| 1 | 0 |
| 1 | 0 |
| 1 | 0 |
| 1 | 0 |

OUTPUTS

| CH.1 L | CH.1 R | CH.2 L | CH.2 R |
|---|---|---|---|
| 1 | 0 | 1 | 0 |
| 1 | 0 | 1 | 0 |
| 1 | 0 | 1 | 0 |
| 1 | 1 | 1 | 1 |
| 0 | 0 | 0 | 0 |
| 0 | 0 | 0 | 0 |
| 0 | 0 | 0 | 0 |
| 1 | 0 | 1 | 0 |
| 1 | 0 | 1 | 0 |

FIG. 12

TOY WHICH MOVES IN SYNCHRONIZATION WITH AN AUDIO SOURCE

This application is a continuation of application Ser. No. 06/868,659, filed on May 28, 1986, now abandoned.

BACKGROUND OF THE INVENTION

The present invention relates to mechanisms which move in synchronization with an audio source. More specifically, the invention relates to toys having movable parts which move in synchronization with a voice or other sound from the toys.

Mechanisms which move in synchronization with an audio source are fascinating to both adults and children alike. For example, in the Country Bear Jamboree exhibit at Disneyland in Anaheim, California, a group of bears and other characters move their eyelids, lips and limbs as they perform songs or speak. A vast number of people have been entertained by this particular exhibit.

For the further enjoyment of consumers, it is highly desirable to provide portable mechanisms, such as toy characters, which move in synchronization with an audio source. In addition, it is desirable to provide such characters with improved drive mechanisms for providing the movement, improved circuitry and mechanisms for synchronization of the movement to the audio source, and in which the audio and movements may be readily varied for greater diversity. In addition, it is also desirable to provide the synchronization of more than one mechanism, i.e. multiple toys or characters, to an audio source. In this way, animated characters may carry on conversations and otherwise interact to thereby add realism to their activities. Therefore, a need exists for toys and other mechanisms in which movement is synchronized to an audio source and which have these and other advantageous characteristics.

SUMMARY OF THE INVENTION

The present invention comprises a mechanism for synchronizing movement, such as the movement of one or more parts of a toy character, with an audio source. Although other sources may be used, in the illustrated embodiment a cassette tape deck is included within the body of a toy character, such as a bird. The tape deck is used to play cassettes which are prerecorded to play audio information on one channel of the tape deck and data information on another channel. The audio information is amplified and delivered to a speaker in the bird so that the bird can speak or sing as desired. Data from the data channel is decoded by a decoder and, in response to the data, drive mechanisms are operated to move desired parts of the bird.

The data channel may also carry address information in the event one or more optional satellite characters are used, in addition to the bird or other master character. When the decoder determines that a satellite character is being addressed and should emit audio instead of the master character, audio from the master character is blocked. Each satellite character includes one or more drive mechanisms for moving various parts of the character. Also, the satellite characters each include a decoder, like the decoder in the master character, for decoding data information and controlling the satellite character's movement when the decoder determines that the character is being addressed. In addition, the satellite characters each typically include speaker circuitry so that they can sing, talk and in effect converse with the master character. However, only the master character need be provided with a tape deck. The movements of the various characters and audio is changed by merely changing the cassettes.

Therefore, it is an overall object of the present invention to provide an improved toy or other mechanism with movable parts synchronized with an audio source.

It is another object of the present invention to provide such a toy which is responsive to data and audio signals recorded on cassette tape or another source.

Still another object of the present invention is to provide a toy comprised of more than one character, each character having movable parts which move in synchronization with audio signals.

Another object of the present invention is to provide a durable, reliable and relatively inexpensive toy.

A further object of the present invention is to provide a drive mechanism for such a toy which is relatively simple, compact and extremely quiet, yet requires relatively little power to produce the desired movement.

These and other objects, features and advantages of the present invention will become apparent with reference to the following description and drawings.

BRIEF DESCRIPTIONS OF THE DRAWINGS

FIG. 12 is a table of data examples useful in explaining the operation of the circuits of FIGS. 9 and 10.

DETAILED DESCRIPTION OF PREFERRED EMBODIMENTS

Drive Mechanisms

FIGS. 1–8 depict a bird character having various movable body parts driven by drive mechanisms in accordance with the invention. However, the drive mechanisms are equally suitable for moving components of other characters and systems. In addition, the circuitry described below is equally suitable for other characters and applications.

Figure 1:
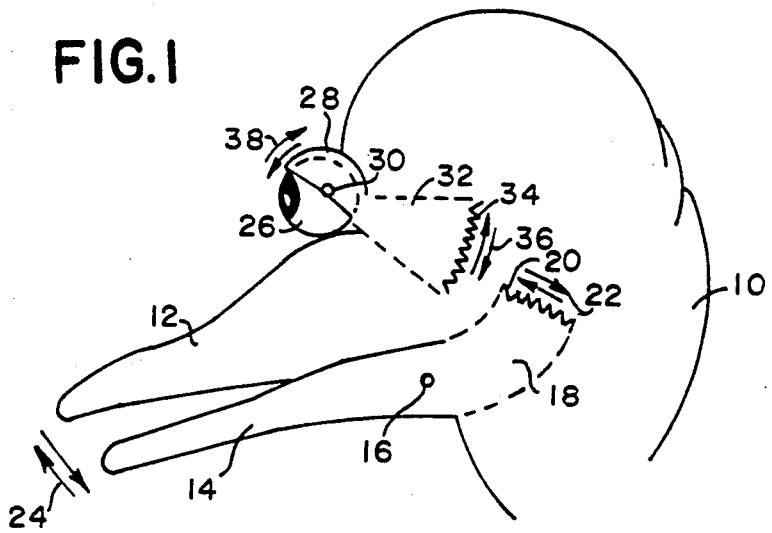
FIG. 1 shows the head of a toy character in accordance with the present invention, together with portions of drive mechanisms for moving the eyelids and lower lip or beak of this particular character.

Referring to FIG. 1, the head 10 of a bird has an upper fixed beak 12 and a lower movable beak 14 pivoted to the head at a pivot 16. Pivot 16 is positioned intermediate the ends of the beak 14. Beak 14 has a lever portion 18 positioned within head 10. The lever 18 terminates in a toothed rack 20. When rack 20 is, driven about pivot 16 in the respective directions indicated generally by arrows 22, the exposed portion of the beak 14 correspondingly moves, as generally indicated by arrows 24. A pair of eyes, one being numbered 26, are rigidly mounted to the head 10. A cup-shaped eyelid 28 is pivoted at location 30 to eye 26. The eyelid 28 is formed with a lever 32 which projects within the head 10 and terminates in a rack 34. The eyelid is mounted such that, as rack 34 is driven about pivot 30 generally in the directions of arrows 36, the eyelid 28 correspondingly moves, as indicated by arrows 38. The eyelids for each eye may each include an independent drive mechanism. However, the eyelids are typically interconnected so that one drive mechanism causes the bird to blink both eyes simultaneously.

Figure 2:
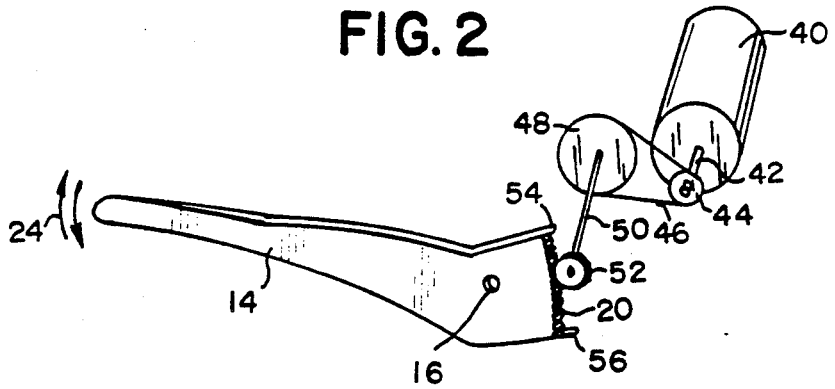
FIG. 2 illustrates the drive mechanism for the lower beak of the character of FIG. 1.

The drive mechanism for the lower beak 14 is shown in FIG. 2 and includes a compact conventional DC motor 40. Motor 40 is capable of rotating a shaft 42 in either direction, depending upon the polarity of the voltage applied to the motor. A pulley 44 is mounted to shaft 42 and connected by a belt 46 to a larger drive pulley 48. Pulley 48 is supported by a shaft 50 which is pivotally mounted to the head 10. A gear 52 is carried by the shaft 50 and positioned to engage the rack 20. Consequently, when motor 40 operates, the shaft 50 is driven by pulleys 44, 48 and the gear 52 rotates to produce the desired movement of rack 20 and the beak 14. Upper and lower stops 54, 56, not shown in FIG. 1, prevent gear 52 from being driven off the rack 20. Also, belt 46 slips under high load conditions to prevent damage to the drive mechanism. The use of a drive gear and rack produces accurate and well-defined motion of beak 14. In addition, both high and low speed motors may be used as desired. Moreover, the drive mechanism is mechanically simple, extremely quiet, and reliable.

Figure 3:
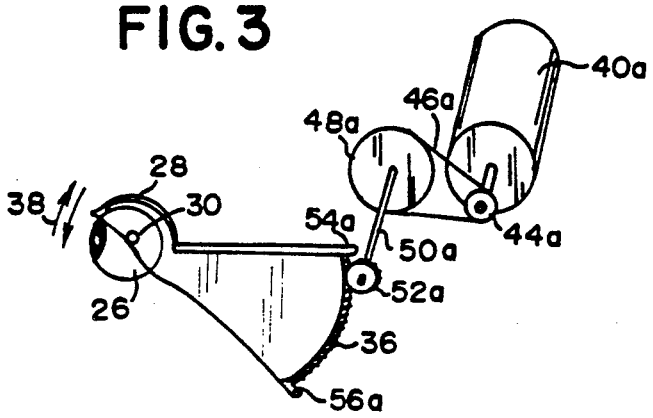
FIG. 3 illustrates the drive mechanism for the eyelids of FIG. 1.

The drive mechanism for the eyelid shown in FIG. 3 is like the drive mechanism for the lower beak shown in FIG. 2. Therefore, corresponding elements in FIG. 3 are identified with corresponding numbers, together with the letter "a" to differentiate the FIG. 3 components from those of FIG. 2.

Figure 4:
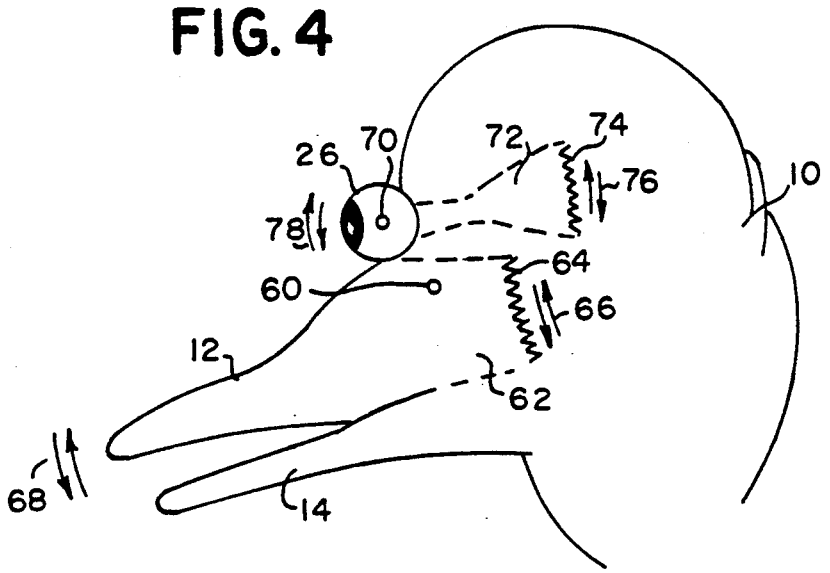
FIG. 4 shows the head of a character in accordance with the present invention, together with portions of drive mechanisms for moving the eyes and upper lip or beak of this particular character.

The FIG. 4 head is similar to the FIG. 1 head. However, in FIG. 4 the upper beak 12 is pivoted at an intermediate point 60 to the head 10 while the lower beak 14 is fixed. In addition, beak 12 includes an internal lever portion 62 which terminates in a rack 64. When rack 64 is driven about pivot 60 in the directions indicated by arrows 66, the exposed portion of beak 12 moves, as shown by arrows 68. Also, eye 26 is pivoted at 70 to the head 10. A lever 72 extends within the head 10 from the back of the eye and terminates in a rack 74. When the rack 74 is driven about pivot 70 in the direction of arrows 76, corresponding movement of eye 26 occurs. The two eyes of the bird may be interconnected for simultaneous movement, if desired.

Figure 5:
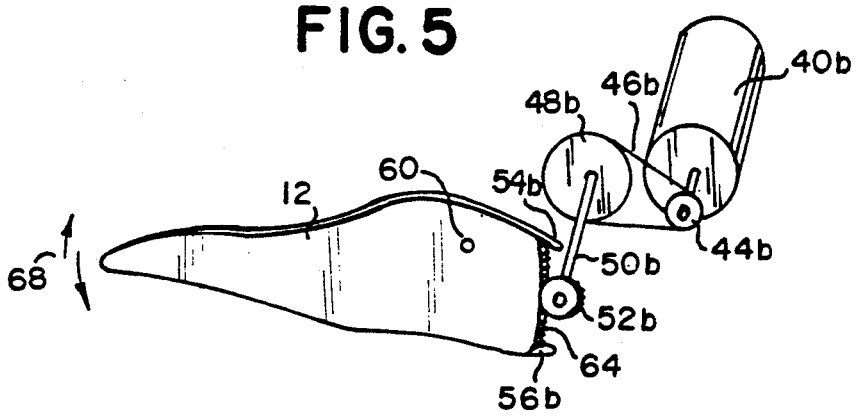
FIG. 5 illustrates the drive mechanism for the upper beak of the character of FIG. 4.
Figure 6:
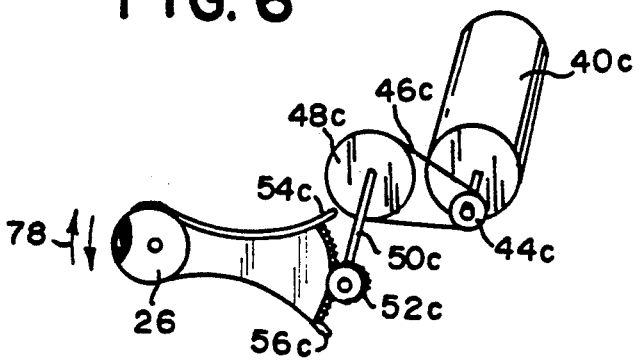
FIG. 6 illustrates the drive mechanism for the eyes of the FIG. 4 character.

FIGS. 5 and 6 show additional portions of the drive mechanism used to move the eyes 26 and upper beak 12 of the FIG. 4 character. As these mechanisms are like the FIG. 2 mechanism, corresponding parts have been indicated with corresponding numbers, together with the respective letters "b" and "c." Consequently, these drive mechanisms will not be discussed in detail.

Figure 7:
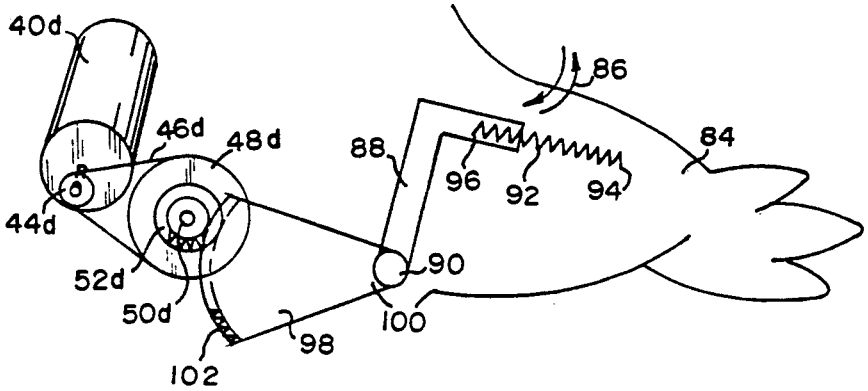
FIG. 7 shows a drive mechanism for moving still another body part, specifically the tail, of the FIGS. 1 and 4 characters.

FIG. 7 depicts an internal drive mechanism utilized for moving the tail 84 of the FIGS. 1 and 4 bird, in the directions indicated generally by arrows 86. The FIG. 7 drive mechanism includes an upwardly extending angular inverted L-shaped arm 88 rigidly mounted to a pivot 90 which is pivoted to the body of the bird. An internal coil spring 92 is connected at one end 94 to the tail 84 and at its other end 96 to a distal end portion of arm 88. A fan-shaped lever 98 is rigidly connected at one end 100 to the pivot 90 and includes a rack 102 at its other end. Arm 88 and rack 102 are positioned for movement in a plane normal to the axis of pivot 90. Also, lever 98 and arm 88 project from pivot 90 in directions which are generally normal to one another. The remainder of the drive mechanism of FIG. 7 is like that shown in FIG. 2. Consequently, corresponding elements are designated by corresponding numbers, except that the FIG. 7 elements include the letter "d." Thus, when gear 52*d* is driven by motor 40*d*, lever 98 pivots the pivot 90. This causes arm 88 to pivot and the tail 84 to move. Spring 92 imparts a somewhat wiggling motion to tail 84 in response to movement of arm 88. This motion mimics the motion of a bird's tail.

Figure 8:
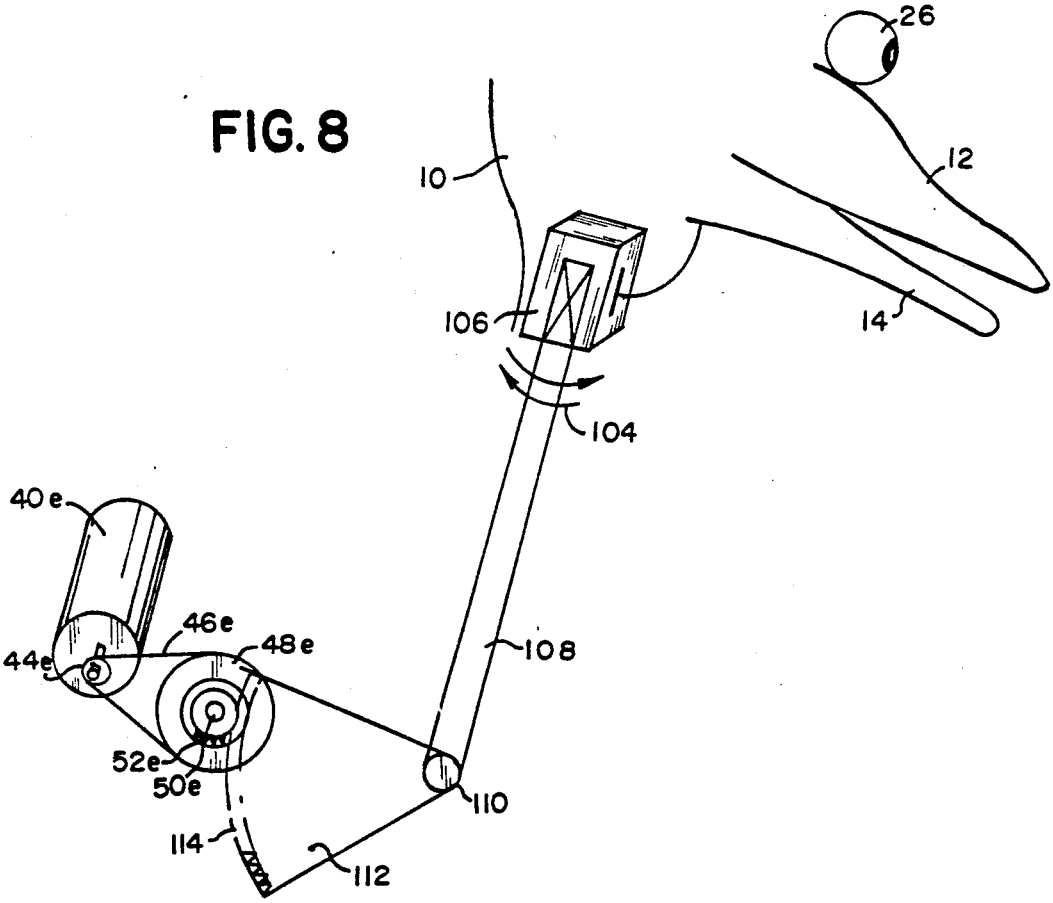
FIG. 8 depicts a drive mechanism for moving a further body part, specifically the head, of the FIGS. 1 and 4 characters.

FIG. 8 shows an internal drive mechanism used for moving the head 10 of the FIGS. 1 and 4 bird in the directions indicated generally by arrows 104. In the FIG. 8 form, the head 10 is connected to a mounting block 106 which is connected to a shaft 108. The shaft 108 is pivoted at 110 to the body of the bird and concealed within the bird's neck. The length of shaft 108 is variable, depending upon the desired length of the bird's neck. In addition, the neck is made of a flexible material. Therefore, the neck is capable of twisting in the directions of arrows 104 as shaft 108 pivots. Although difficult to discern in FIG. 8, a lever 112 is rigidly coupled to shaft 108 and projects from the shaft in a direction generally normal to the shaft axis. A rack 114 is provided at the distal end of the lever 112 and is driven by a drive mechanism like that shown in FIG. 2. Consequently, elements of the FIG. 8 drive mechanism which correspond to those in FIG. 2 are designated with like numbers, except that the FIG. 8 elements include the letter "e." With the FIG. 8 drive mechanism, when gear 52*e* is driven by the motor 40*e*, shaft 108 and head 10 twist.

Although not shown in FIGS. 7 and 8, the levers 98, 112 are also provided with stops to prevent gears 52*d* and 52*e* from leaving racks 102, 114.

Electrical Circuit

General Description

Figure 9:
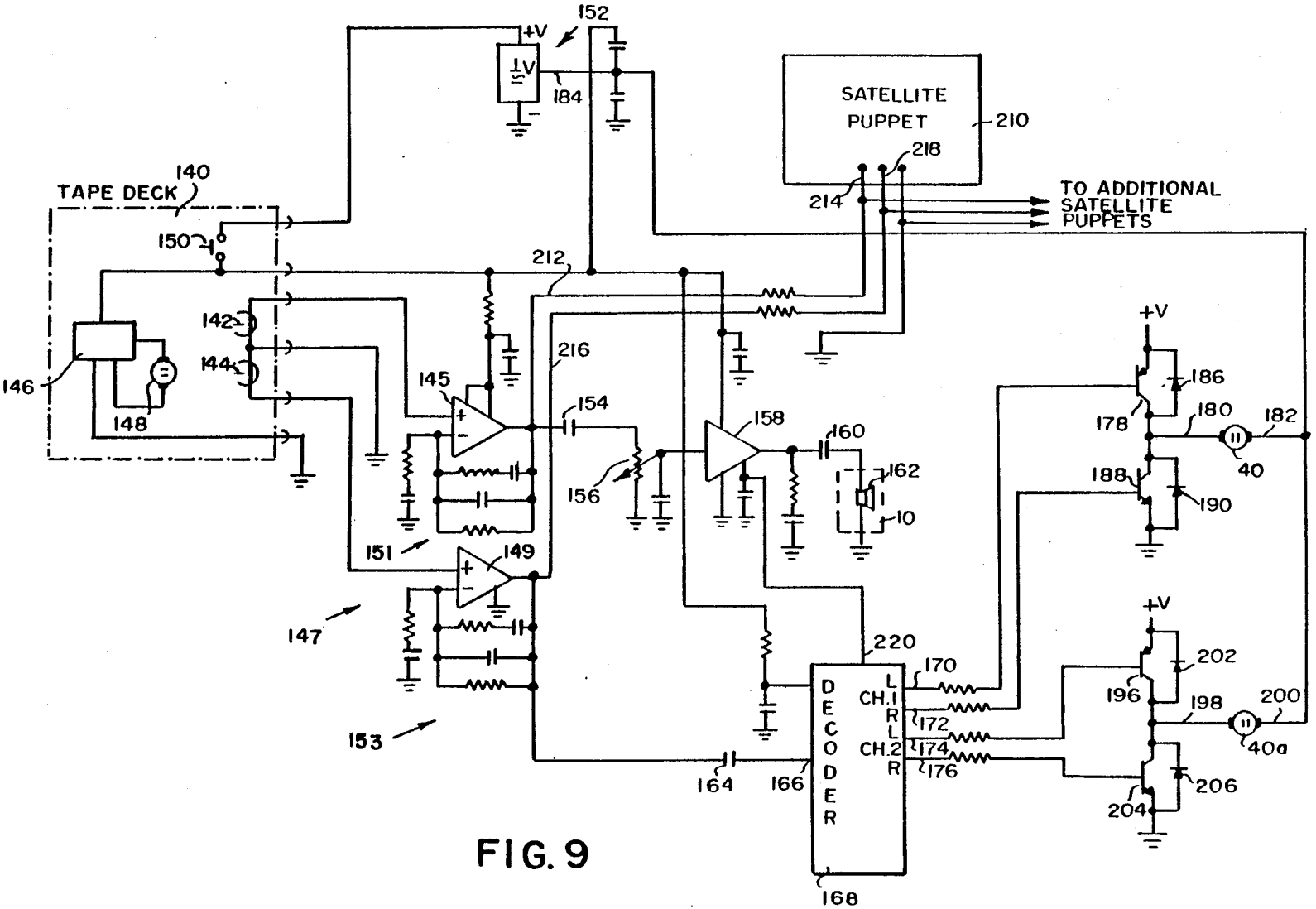
FIG. 9 is an electrical schematic diagram of a circuit utilized in toys of the present invention.

Referring to FIG. 9, the bird character has a plural channel tape deck 140 for playing cassette tapes which are prerecorded so that audio is played on one channel 142 of the tape deck and data information is played on another channel 144. The tape deck 140 is conventional and has a motor 148 controlled by a motor regulator circuit 146. When a cassette tape is inserted into the tape deck, a main switch 150 closes. Power is then delivered from a battery pack 152 through the switch and to the motor regulator circuit 146 so that the tape deck operates to play the cassette tape. Of course, record players and other playback devices may also be used.

The audio signals on channel 142 are fed to the non-inverting input on amplifier 145, which comprises one amplifier of a dual preamplifier circuit 147. This circuit includes a second amplifier 149 with its non-inverting input connected to the data channel 144 for purposes explained below. Each of the amplifiers 145, 149 has a respective resistive-capacitive feedback circuit 151, 153 connected from the output to the non-inverting input of the associated amplifier. The amplified audio signal from amplifier 145 is coupled through a DC blocking capacitor 154 and a volume control potentiometer 156 to an audio amplifier 158. The amplified signal from amplifier 158 is coupled through a capacitor 160 to a speaker 162 located in the head 10 of the bird. Consequently, singing, conversation and other sounds recorded on the cassette tape and played on audio channel 142 are delivered to the character. The volume of the audio is adjusted by potentiometer 156.

The data on data channel 144 is amplified by amplifier 249 and coupled through a capacitor 164 to a data input 166 of a decoder circuit 168. In the illustrated embodiment, as explained in greater detail below, data in the form of a frequency modulated signal is presented to the decoder. One exemplary data signal is labeled "input" in FIG. 11. The decoder 168 determines, from the data signal, which, if any, of the drive mechanisms is to be operated and the desired direction of operation. The decoder has plural output channels, one for each drive mechanism motor. Two of these channels, CH. 1 and CH. 2 are shown in FIG. 9 for respectively driving the lower beak operating motor 40 (FIG. 2) and eyelid operating motor 40*a* (FIG. 3). Additional outputs, not shown, are provided for driving additional motors as desired.

More specifically, decoder 168 has CH. 1 outputs L, R, which are also designated as 170, 172. In addition, the decoder has CH. 2 outputs L, R, also indicated as 174, 176. Output 170 is connected through a resistor to the base of a PNP transistor 178. The emitter of transistor 178 is connected to the positive supply voltage (+V), from battery pack 152. The collector of this transistor is connected to one side 180 of the beak driving motor 40. The other side 182 of motor 40 is connected to a terminal 184 of the battery pack which is at a voltage which is approximately one-half V+. A diode 186 has its anode connected to the collector of transistor 178 and its cathode connected to the emitter of this transistor. In addition, the CH. 1 output 172 is connected through a resistor to the base of an NPN transistor 188. Transistor 188 has its emitter grounded and its collector connected both to the collector of transistor 178 and also to line 180. A diode 190 has its anode connected to the emitter of transistor 188 and its cathode connected to the collector of this transistor.

When connected in this manner, transistors 178 and 188 are both off when the CH. 1 L output 170 is at a positive or logic one level and the CH. .1 R output 172 is at a zero logic level. In this case, motor 40 does not operate. In contrast, assume the CH. 1 output 170, under the control of decoder 168, drops to a zero logic level. In this case, transistor 178 conducts. Current then flows from the positive voltage supply, through the transistor 178, and through the motor 40 to drive the motor and beak in a first direction. On the other hand, if the CH. 1 R output 172 changes to a positive or logic one level, transistor 188 conducts. Current then flows from terminal 184, through the motor 40 and transistor 188 and drives the motor and moves the beak in the opposite direction.

The CH. 2 L output 174 is connected through a resistor to the base of a PNP transistor 196. The emitter of this transistor is connected to the positive voltage supply. Also, the collector of this transistor is connected to one side 198 of the eyelid driving motor 40*a*. The other side 200 of motor 40*a* is connected to terminal 184 of the battery pack. The collector of transistor 196 is also connected to the anode of a diode 202, which has its cathode connected to the emitter of this transistor. In addition, the CH. 2 R output 176 is connected through a resistor to the base of an NPN transistor 204, which has its emitter grounded. The collector of transistor 204 is connected to side 198 of motor 40*a* and also to the collector of transistor 196. A diode 206 has its anode grounded and its cathode connected to the collector of this transistor.

When the CH. 2 L output 174 is at a positive or logic one level and the CH. 2 R output 176 is at a zero logic level, as controlled by decoder 168, both the transistors 196, 204 are off. In this case, motor 40*a* is not driven and the eyelid of the character remains stationary. When the CH. 2 L output 174 drops to a zero logic level, under the control of decoder 168, transistor 196 conducts. In this case, current flows from the voltage source, through transistor 196 and through motor 40*a* to the battery terminal 184. This drives motor 40*a* in one direction and correspondingly moves the eyelid. When, under the control of decoder 168, the CH. 2 R output 176 changes to a positive or logic one level, transistor 204 conducts. In this case, current flows from terminal 184, through motor 40*a*, and through transistor 204. This drives motor 40*a* and the eyelid in the opposite direction.

The toy may be provided with one or more optional satellite puppets or characters, one being designated 210 in FIG. 9. The audio output from amplifier 144 is fed on a line 212 and through a resistor to an audio input 214 of the satellite puppet. The satellite puppet has an audio circuit like that of the master character so that the satellite puppet is also capable of emitting sound. In addition, the data output from amplifier 148 is fed via a line 216 and through a resistor to a data input 218 of the satellite puppet. In addition to carrying information used to control the motion of body parts, data channel 144 also transmits address information to indicate that the satellite puppet 210 is being addressed. Decoder 168 determines when the satellite puppet is being addressed and blocks the drive mechanisms of the main character from responding to drive motor control data intended for the satellite puppet. The satellite puppet 210 also includes a decoder for determining that it is being addressed. In addition, the satellite puppet also includes movable body parts and drive mechanisms for such parts which are like the mechanisms shown in FIGS. 1–8. Upon determining that it is being addressed, the satellite puppet decoder responds to data signals which controls the satellite puppet drive mechanisms and thus its motion.

Along with address information, the data channel 144 carries instructions for selectively muting the bird or master character as desired. When decoder 168 detects that the master character is to be muted, a muting signal is delivered from an output 220 of decoder 168 to a switch, not shown, within audio amplifier 158. In response to the muting signal, the output from audio amplifier 158 is blocked and the master character does not speak or otherwise emit sound. The decoder in satellite puppet 210, like decoder 168, also provides a muting signal for selectively muting the satellite puppet. In this way, in response to information on data channel 144, audio is controlled from the various characters. Consequently, the characters can be controlled to in effect, for example, carry on conversations or sing together. In addition, only one tape deck 140 is required as all of the information is delivered through the master character to the various satellite puppets.

Decoder Circuit

General Description

The decoder circuit 168 and its operation will next be described with reference to FIGS. 10 and 11. In the illustrated embodiment, the data and satellite puppet address information reaching input 166 of the decoder comprises a frequency modulated stream of twelve-bit words. Valid data and address words each start and stop with a logic zero bit to permit recognition of valid data and address words. In addition, each valid address and data word is followed by at least one complete twelve-bit blank word comprised entirely of logic one bits. The blank words allow the decoder to reset itself between valid data and address words. An address/data bit ($\overline{A}/D$) follows the start bit. If this bit is a logic one, the decoder recognizes that the following eight bits (D7, D6, . . ., D0) comprise data bits which determine the body part to be moved as well as the direction of motion. These data bits are followed by a parity bit used in checking the validity of the data and address information, as explained below. Again, the last bit comprises a stop bit. Assume that the $\overline{A}/D$ bit is logic zero instead of a logic one. In this case, the next bit of the word is a channel enable bit (CH. $\overline{ON}$). When the channel enable bit is a logic one, decoder 168 disregards data as the data is for the addressed satellite puppet. A mute bit follows the channel enable bit. If the mute bit is a logic one, decoder 168 sends a positive signal at output 220 to amplifier 158. This shuts off the audio from the master character. In contrast, if the mute bit is a logic zero, the master character is not muted and continues to emit audio. Six address bits (A5, A4, . . ., A0) follow the mute bit. These address bits determine which of the satellite puppets 210 are being addressed. This number of address bits allows addressing of up to sixty-four satellite animals, although, as explained below, the illustrated decoder 168 only addresses the satellite puppet 210.

Figure 10:
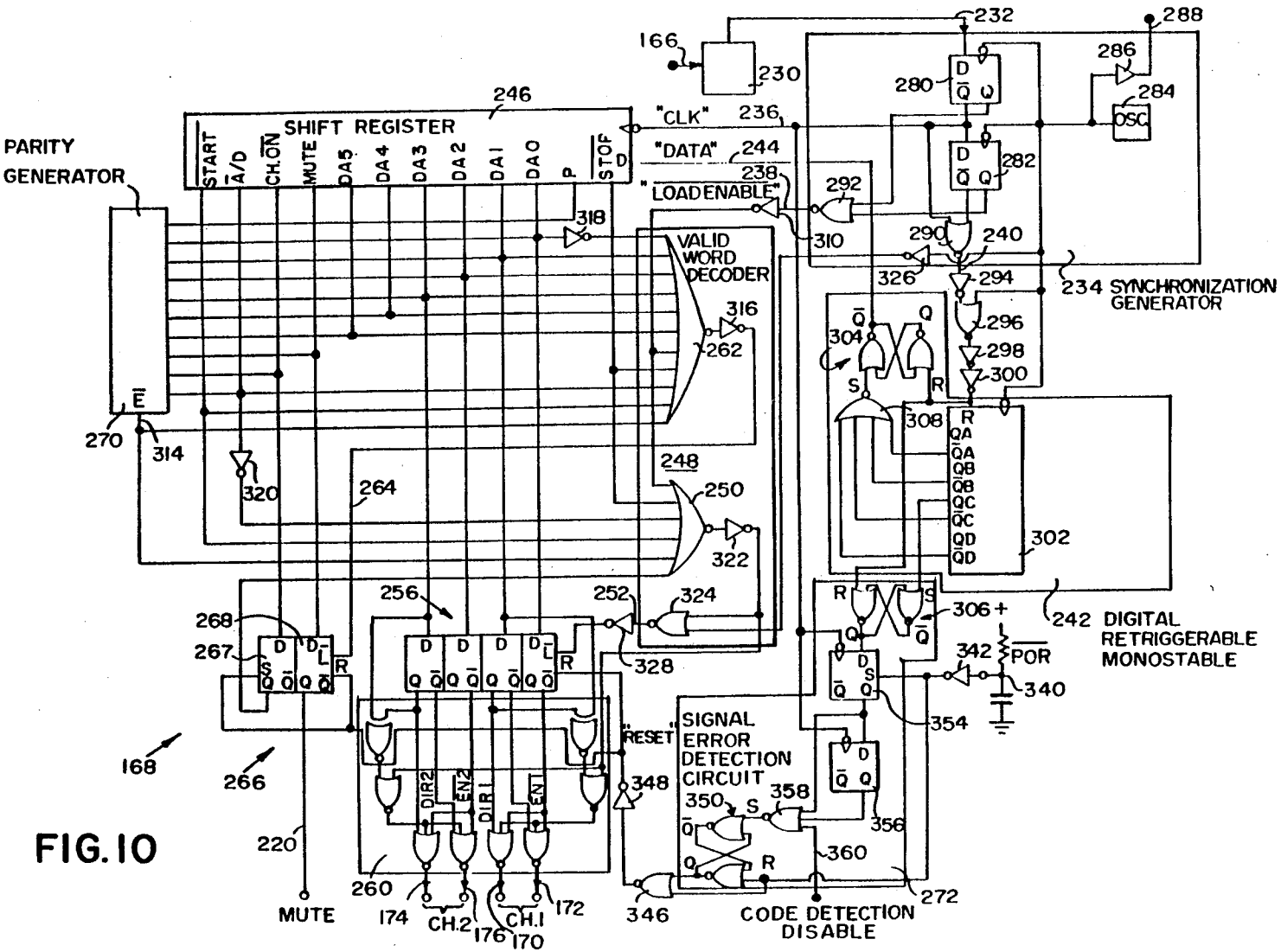
FIG. 10 is an electrical schematic diagram of a decoder portion of the circuit of FIG. 9.
Figure 11:
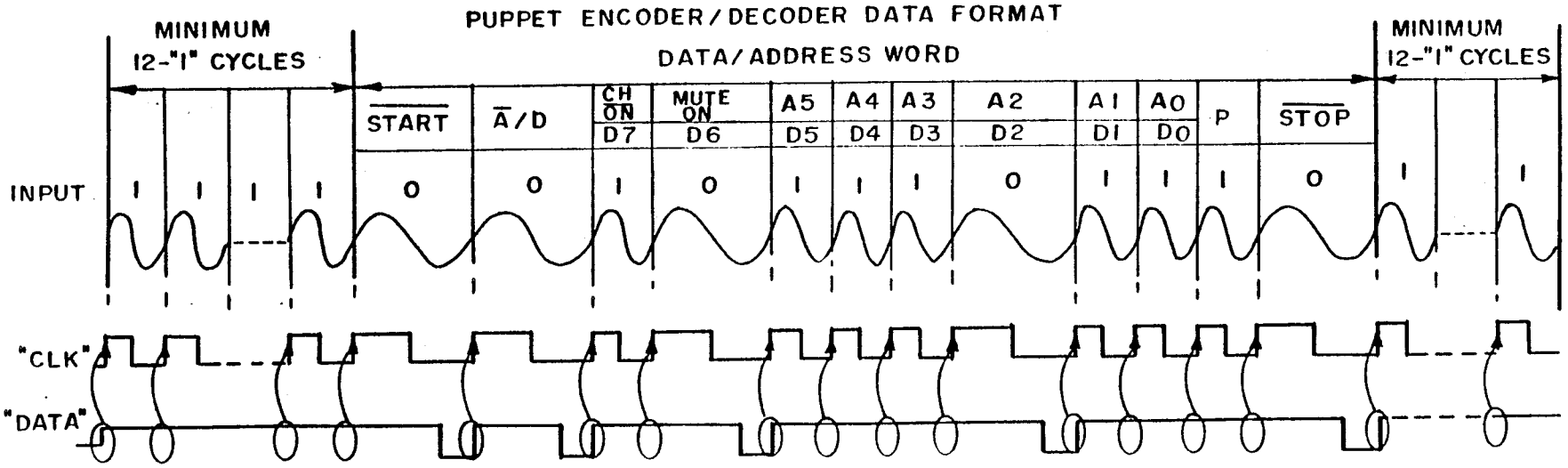
FIG. 11 is an illustration of an exemplary data format for cassette tapes containing audio and data used in the toys of the present invention.

With this format information in mind, and with specific reference to FIG. 10, the frequency modulated coded input 166 is first squared by a Schmitt trigger 230 to provide a square-wave demodulated signal at 232. This signal is fed to a synchronization generator 234 which synchronizes the asynchronous data and address information input to an oscillator signal for use by the decoder circuit. The synchronization generator 234 produces a clocking ("CLK") output on a line 236 and a "load enable" output on a line 238 for purposes explained below. The synchronization generator also generates an output 240 which corresponds to the synchronized data and address information. The synchronization generator output 240 is coupled to a digital retriggerable monostable circuit (Dmono) 242 which recovers the data and address bits from the encoded input signal received at decoder input 166. The captured data appears at a "data" output 244 of the Dmono circuit 242 and is clocked into a twelve-bit shift register 246 in response to CLK signals on line 236.

A valid word decoder circuit 248 monitors the bits stored in shift register 246 and determines whether an address or data word is presented. More specifically, the valid word decoder circuit 248 includes a first data word detecting NOR gate 250 for detecting the presence of a data word within shift register 246. When a data word is detected, an appropriate signal, explained below, is generated at an output 252 of the valid word decoder and coupled to a data latch 256 comprised of four flip-flops. In response to this signal, data bits D0 through D3 are clocked through the flip-flops of latch 256 to the CH. 1 and CH. 2 outputs 170 through 176. A short circuit protection circuit 260 prevents the pair of transistors 178, 188 and the pair of transistors 196, 204 (FIG. 9) from simultaneously conducting and completing an electrical short circuit through the respective transistor pairs.

The valid word decoder circuit 248 also includes circuitry for determining that a particular satellite puppet is being addressed. In the illustrated form, this circuitry includes a NOR gate 262 which produces an appropriate output on the line 264 when a valid satellite puppet address is detected. Line 264 is connected to a status latch 266 comprised of a channel enable flip-flop 267 and a mute control flip-flop 268. When a valid puppet address is detected, the output on line 264 loads the shift register channel enable bit and mute bit, at the inputs to flip-flops 267, 268, to the outputs of the status latch. Specifically, assume the main character is to be muted so that the mute bit is a logic one.

Upon the detection of a valid puppet address, the logic one mute bit from the shift register is delivered to status latch output 220 and the main character is muted. In addition, if the drive channels of the satellite character being addressed are to be enabled for movement of the satellite character, the shift register CH. $\overline{ON}$ bit is a logic one. This bit is clocked to the Q output of flip-flop 267 and applied to one input of the data word detecting gate 250. This holds the output 252, from the valid word decoder circuit 248, at a logic zero. Consequently, data is not clocked through data latch 256 and the drive mechanisms of the main character do not operate. Instead, data is retrieved by a decoder in the satellite puppet and used to control movement of drive mechanisms in the satellite puppet.

The decoder circuit 168 also includes a parity checking circuit 270 for evaluating the parity of data and address words stored in the shift register. Circuit 270 disables the data latch 256 and status latch 266, as explained below, in the event the parity of the words is not verified. In addition, the decoder 168 includes a signal error detection circuit 272 which looks for high frequency audio signals at decoder input 166. Such signals could occur, for example, if a standard cassette tape were played in tape deck 140 (FIG. 9) rather than a cassette tape prerecorded in the FIG. 11 format. When such errors are detected, the CH. 1 and CH. 2 outputs are at levels such that the character drive mechanisms are not operated in an undesired sporadic manner.

Decoder Circuit

Specific Description

With the general overview of the decoder circuit 168 in mind, the more specific details of this circuit will be understood from the following description.

The synchronization generator 234 includes first and second D-type flip-flops 280, 282 clocked by clocking signals from an oscillator 284. For reasons explained below, the oscillator clocking signals are set at a rate (for example, 4500 Hz) which is nominally thirty-two times the zero logic pulse rate of the coded signal on line 166 and eight times the one logic pulse rate of such signals. The oscillator output is buffered by an amplifier 286 and fed on a line 288 to the satellite puppets for synchronization of the satellite puppets to the master character. The D input of flip-flop 280 receives the demodulated output 232 from Schmitt Trigger 230. The $\overline{Q}$ output of flip-flop 280 is connected to the D input of flip-flop 282 and also comprises the CLK signal on line 236 to shift register 246. Also, the $\overline{Q}$ output of flip-flop 280 is connected to one input of a NOR gate 290. The Q output of this flip-flop 280 is connected to one input of a load enable controlling NOR gate 292. The $\overline{Q}$ output of flip-flop 282 is connected to another input of NOR gate 290 while the Q output of this flip-flop is connected to an input of NOR gate 292. Positive going asynchronous input pulses are synched to flip-flop 280 at the falling edge of clock pulses from oscillator 284. These input pulses are then synchronized to flip-flop 282 at the next falling edge of the oscillator output.

Assume that a logic one signal is applied to the D input of flip-flop 280. Also assume that the logic one signal has just entered its negative half cycle. In this case, a zero appears at the D input of flip-flop 280. At the next oscillator pulse, the D input to flip-flop 282, the CLK signal on line 236 and the input to gate 290 from flip-flop 280 all go to a one. At the next oscillator pulse, the $\overline{Q}$ output from flip-flop 282, and thus the other input to gate 290 goes to a zero. Because one of the inputs to gate 290 is a one, the output at 240 is a zero. Inverter 294 inverts the signal at 240 and, in this case, applies a one to an input of a NOR gate 296. The other input of NOR gate 296 is coupled to the output of oscillator 284. Because one of the inputs to gate 296 is a one, its output is a zero and, following inversion by a pair of inverters 298, 300, appears as a zero at the reset input to a four-bit binary counter 302 within the Dmono circuit 242. This signal from inverter 300 is also applied to the reset input of a set-reset flip-flop 304 within circuit 242 and the reset input of a set-reset flip-flop 306 within error detection circuit 272 for purposes explained below. Initially, the $\overline{Q}$ output of flip-flop 304 is at a logic one level. Counter 302 has four $\overline{Q}$ outputs connected to the inputs of a NOR gate 308 which has its output applied to the set or S input of flip-flop 304. Because the initial count is zero, each of these $\overline{Q}$ outputs is initially a one and the output of NOR gate 308 is a zero. Because the oscillator frequency is nominally eight times the frequency of the logic one signals, and because in this example a logic one signal is applied at input 232 to the synchronization generator, the fourth $\overline{Q}$ output of counter 302 does not drop to a zero before the counter is reset by the next zero signal from inverter 300. Therefore, the $\overline{Q}$ output of flip-flop 304 remains a one and appears on dataline 244. The signal at 232 eventually goes positive at the positive half cycle of the logic one input signal. Upon the next oscillator pulse, the clock signal on line 236 falls and clocks the data from line 244 into the shift register. In comparison, if a logic zero signal is applied at input 232, the fourth $\overline{Q}$ output of 302 will drop to zero before the counter 302 is reset. In this case, the $\overline{Q}$ output of flip-flop 304 drops to zero. Therefore, upon the next clocking pulse on line 236 a logic zero data signal is clocked into the shift register.

At the first clocking pulse following the application of a one to the D input of flip-flop 280, the input to gate 292 from flip-flop 280 goes to a one. One clocking pulse later, the other input to gate 292, from the Q output of flip-flop 282 is a zero. This is because a zero is applied to the D input of flip-flop 282 from the $\overline{Q}$ output of flip-flop 280. Thereafter, when the input signal at 232 drops to a zero, at the next pulse from oscillator 284, the Q output of flip-flop 280 drops to zero. At this time, and until the next oscillator pulse when the Q output from flip-flop 282 to gate 292 changes to a one, the output from gate 292 at 238 is a one. When inverted by inverter 310, a zero load enable signal is applied to NOR gate 250, 262. This enables these gates to produce a one output used in clocking latches 256, 266 in the event the other inputs to either of the gates 250, 262 are also at the logic zero level. Therefore, once each data and address word cycle, a load enable signal is delivered to the gates 250, 262. When this occurs, a determination is made by the valid word decoder circuit 248 as to whether valid address or data words are present in the shift register 246.

Parity generator 270 is conventional and receives as its inputs all but the start and stop bits from shift register 246. Whenever an even number of logic one data bits are present at the inputs to the parity generator, a one appears at output 314 of this circuit and is delivered to an input of each of the NOR gates 250, 262. This in effect disables the valid word decoder circuit 248 from detecting either a valid address or valid data word because an error exists in the word stored in the shift register as data is prerecorded on the cassette tape with the correct parity. In contrast, when an odd number of logic one bits appear at the inputs to parity generator 270, the output 314 is a zero. This enables gates 250, 262 to detect valid data and address words.

The satellite puppet address detecting gate 262 has as its inputs the start and stop bits, the $\overline{A}/D$ bit, the parity and load enable signals, and the address bits A0 through A5. Only when each of these inputs is zero does gate 262 produce a one output which, when inverted by inverter 316 and applied to latch 266, clocks data at the D inputs of this latch to its Q outputs. As pointed out above, valid words require both the start and stop bits to be zero. In addition, the input to gate 262 from parity generator 270 is a zero when the parity is correct. Furthermore, the load enable signal is also a zero at one time during each cycle of the coded input data bits. The $\overline{A}/D$ bit is also a zero when address words are present in the shift register. In the configuration shown, the A0 shift register bit is fed through an inverter 318 to the valid word decoder while each of the Al through A5 data bits is fed directly from the shift register 246 to the gate 262. Therefore, assuming the start, stop, $\overline{A}/D$, parity and load enable inputs to gate 262 are each zero, then the remaining gate inputs will only be zero if the address bits A0 through A5 are respectfully one, zero, zero, zero, zero and zero. In the FIG. 9 form of the invention the address one, zero, zero, zero, zero and zero is assigned to satellite puppet 210. Therefore, whenever this address occurs, decoder 168 determines that the satellite puppet is addressed. Additional gates like gate 262, may be employed to detect the address of other puppets if more than one satellite puppet is used.

Data word detecting gate 250 also receives the start and stop bits from shift register 246 together with the load enable signal parity signals. In addition, the $\overline{A}/D$ bit from shift register is fed through an inverter 320 to gate 250. Consequently, whenever the $\overline{A}D$ bit is zero, corresponding to an address word, a one is applied from inverter 320 to gate 250. This controls gate 250 to prevent clocking of data into data latch 256. In addition, gate 250 receives an input from the Q output of the channel enable flip-flop 267 of status latch 266. Upon the detection of a valid puppet address and the loading of a logic one channel enable bit to the Q output of flip-flop 267, a one is applied from this flip-flop to gate 250. This in effect blocks the operation of the drive mechanisms of the master character while the drive mechanisms of the satellite puppets are operated in response to data words.

Assume that all of the inputs to gate 250 are a zero. In this case, the resulting one output of this gate is inverted by an inverter 322 and the inverter output is applied as a zero to one input of a NOR gate 324. The output 252 from valid word decoder circuit 248 is taken from the output of NOR gate 324. The signal from oscillator 284 is inverted by an inverter 326 and applied to the other input of gate 324. Whenever both inputs to gate 324 are zero, the output 252 is a one. Output 252 is inverted by an inverter 328 and applied to the clocking input of latch 256. When the inverter 328 output drops to zero, data bits D0 thought D3 of shift register 246 are clocked to the outputs of the flip-flops which make up latch 256. This controls the drive mechanisms of the master character. Although not shown, another latch like latch 256 may be employed and coupled to data outputs D4 through D7 to provide two additional channels for controlling additional drive motors and movable body parts of the character.

The error detection circuit 272 and power on reset circuit will next be described. When power to the apparatus is turned on, for example, by inserting a cassette tape, a zero signal is applied to the $\overline{POR}$ input 340 of the circuit. This signal is inverted by an inverter 342 to apply a logic one signal to one input of a NOR gate 346. The resulting one output from gate 346 is inverted by an inverter 348 and applied to latches 256, 266 to reset these latches. When reset the CH. 1 and CH. 2 outputs 170 through 176 are respectively one, zero, one and zero so that the drive mechanisms of the main character do not operate. In addition, the $\overline{Q}$ outputs of the flip-flops 266, 267 of latch 266 are both set equal to zero. The $\overline{POR}$ signal is derived from a Schmitt trigger input (not shown) with a pull up resistor so that the $\overline{POR}$ signal rises to a one state. When this occurs, the input to gate 346 from inverter 342 drops to a zero. The output of gate 346 goes to a one because its other input, from the Q output of a set-reset flip-flop 350 within error detection circuit 272, is a zero. The resulting one output from gate 346 is inverted by inverter 348 and applied as a zero to the reset input of latches 256, 266. In addition, the reset input to flip-flop 350 also goes to a zero.

Error detection circuit 272 is designed to detect the occurrence of two consecutive high frequency input pulses at input 166. The occurrence of such pulses would indicate that audio information is being fed to the data channel in error. When this occurs, data is not clocked into the latches 256, 266.

The signal error detection circuit 272 includes first and second D-type flip-flops 354, 356. Flip flop 354 is set to its initial condition by the $\overline{POR}$ signal. The D input to flip-flop 354 is taken from the Q output of set-reset flip-flop 306 while the D input to flip-flop 356 is taken from the Q output of flip-flop 354. The Q outputs of flip-flops 354, 356 are also fed to two inputs of a three input NOR gate 358. The other input of NOR gate 358 is taken from a code detection disable (CDS) input 360. Flip flops 354, 356 are clocked by clocking signals on line 236.

During normal operation, the CDS input 360 is a zero while the other inputs to gate 358 are never both zero. Consequently, the output of gate 358, and thus the S input to flip-flop 350, remains at a zero and the Q output of flip-flop does not change. When the reset signal to counter 302 goes to zero, the third Q output of this counter is also zero as the counter has not counted high enough for this Q output to be a one. In addition, the Q output of flip-flop 306 is a zero. When either a logic one or logic zero data pulse is being processed, the third Q output of counter 302 will go to a one prior to the occurrence of a CLK signal on line 236. When this happens, the S input to flip-flop 306 goes to a one and the Q output of this flip-flop also goes to one. When the CLK pulse occurs, the Q output from flip-flop 354 is a one so that the output of gate 358 does not change. However, if two consecutive high frequency pulses occur, the zero at the Q output of flip-flop 306 is clocked through both flip-flops 354 and 356 before the S input to flip-flop 306 is switched to a one. In this case, each of the inputs to gate 358 is a zero. Therefore, the S input to flip-flop 350 changes to a one. Consequently, the Q output of flip-flop 350 becomes a one and the output of gate 346 goes to zero. When inverted by invertor 348, a reset signal is then applied to latches 256, 266 so that the character's drive mechanisms do not operate. In this manner, the signal error detection circuit monitors the data delivered at input 166 for purposes of detecting high frequency audio signals.

The operation of the decoder of FIG. 10, as described above, will become more apparent with the reference to the data format examples of FIG. 12. In the first example, the $\overline{POR}$ signal is a zero and the CDS signal is a zero. In this case, the error detection circuit 272 is examining the data for two consecutive high frequency pulses. In addition the CH. 1 L and CH. 2 L outputs are ones. Also, the CH. 1 R and CH. 2 R outputs are zero. In this case, neither of the motors 40, 40*a* is operated.

In the examples two and three, because the $\overline{A}$/D bit is a zero, an address word is present in each case. In addition because the CH. $\overline{ON}$ bit is a zero, the drive channels of the satellite puppet are enabled in each case. In addition, in the second example, the mute bit is a one so that the main character is muted. In the third example, the mute bit is a zero so the main character is not muted. In each of these examples, the address bits A0 through A5 are respectively one, zero, zero, zero, zero and zero so that the satellite puppet 210 is properly addressed. In addition, in each of these cases, the number of logic one bits evaluated by the parity generator circuit 270 is odd so that gates 250, 262 are not disabled by the parity generator.

In the fourth through eighth examples, the $\overline{A}$/D bit is in each case a logic one. This indicates that data words are present instead of address words. In the fourth example, the CH. 1 R and the CH. 2 R outputs are one so that motors 40 and 40*a* are driven in the desired direction. In addition, the CH. 1 L and CH. 2 L outputs are one so that the transistors associated with these outputs are off. In contrast, in the fifth example the CH. 1 L and CH. 2 L outputs are zero. Therefore, the motors 40 and 40*a* are being driven in the opposite direction than in the FIG. 4 example. In addition, the CH. 1 R and CH. 2 R outputs are zero so that the transistors associated with these outputs do not conduct. In the sixth example, the stop bit is a one when it should be a zero for a valid word. Consequently, a logic one stop bit is applied to an input of data word detecting gate 250 and to an input of address word detecting gate 262. Therefore, these gates do not indicate the presence of either a valid address word or valid data word. In the seventh example, the parity is wrong. Consequently, a logic one signal is applied from parity generator 270 to inputs of gates 250, 262. Therefore, the gates do not indicate the presence of either a valid address word or a valid data word. In the eighth example, a data example, all of the outputs are off. Finally, the ninth example comprises an address word as indicated by the fact that the $\overline{A}/D$ bit is a zero. In addition, because the mute bit is a one, the mute is on and the main character is muted. Audio would be emitted by the satellite puppet 210.

Having illustrated and described the principles of my invention with reference to several preferred embodiments, it should be apparent to those skilled in the art that such invention may be modified in arrangement and detail without departing from such principles.

I claim as my invention all such modifications as come within the true spirit and scope of the following claims.

1. A toy adapted for producing sound in response to audio signals recorded on a source and adapted for moving in response to data signals on the source, comprising:

a body;

cassette tape player means mounted to the body and having an audio channel and a data channel, the tape player means comprising means for playing audio signals from the source on the audio channel and for playing data signals from the source on the data channel;

speaker circuit means in the body and coupled to the audio channel for receiving the audio signals and producing sound in response to the audio signals;

the body having a first body part which is movable relative to the rest of the body;

decoder circuit means coupled to the data channel for receiving the data signals and for producing an output of digital drive signals in response to the data signals, the data signals comprising frequency modulated data words prerecorded on the source, the decoder circuit means including data word detection means for detecting the data words in the data signal and for producing the digital drive signals in response to the detected data words; and first drive means having an input coupled to the decoder circuit means for receiving the digital drive signals, the first drive means comprising means for moving the first body part in response to a predetermined digital combination of the digital drive signals.

2. A toy according to claim 1 in which the source includes prerecorded address signals and the player means comprises means for playing the address signals on the data channel, the speaker circuit means including muting means for selectively muting sound from the speaker circuit means in response to muting control signals, the toy including additionally at least one satellite character having an address designated by the address signals, and the decoder circuit means comprising means for receiving the address signals and including muting control means coupled to the muting means for selectively delivering muting control signals to the muting means upon detection of the satellite character address.

3. A toy according to claim 1 further including a satellite character, and in which the source includes prerecorded satellite data signals and the tape player comprises means for playing the satellite data signals on the data channel, and in which the satellite character has a satellite body with at least one satellite body part which is movable relative to the satellite body, the satellite character having a satellite decoder circuit means coupled to the data channel for detecting the addressing of the satellite character, the satellite character having first satellite drive means with an input coupled to the satellite decoder circuit means for receiving satellite data signals from the data channel when the satellite character is addressed, the satellite first drive means comprising means for moving the first satellite body part in response to the satellite drive signals.

4. A toy according to claim 1 in which the decoder circuit means includes synchronization signal generator means for synchronizing the data signals, digital retriggerable monostable circuit means for converting the data signals to an output of word bits, shift register means coupled to the word bit output for storing data words therein, the synchronization signal generator means including clocking means for clocking word bits into the shift register means, the shift register means having shift register outputs representing the word bits therein, data word detector circuit means coupled to the shift register outputs for determining the presence of data words in the shift register from such outputs, and data latch means controlled by the data word detector means and coupled to the shift register outputs for producing drive signals which correspond to the data words in the shift register.

5. A toy according to claim 4 in which the data signals include frequency modulated address words prerecorded on the source, the decoder having address word detector circuit means coupled to the shift register outputs for determining the presence of address words in the shift register, and status latch means controlled by the address word detector means and coupled to the shift register outputs for producing first and second status latch output signals which correspond to the address words in the shift register, the speaker circuit means including muting means for selectively muting sound from the speaker circuit means in response to muting control signals, the status latch means being coupled to the muting means for delivery of the first status latch output signals to the muting means as the muting control signals, the status latch means being coupled to the data word detector circuit means for delivery of the second status latch output signals to the data word detector means, the data word detector means comprising means for selectively blocking the delivery of drive signals from the data latch means in response to the second status latch output signals.

6. A toy according to claim 5 in which the parity of the words of the prerecorded data signals is a first value, the toy including parity circuit means having inputs coupled to the shift register outputs, the parity circuit means having an output coupled to the data word detector circuit means and to the address detector circuit means, the parity circuit means comprising means for evaluating the parity of the shift register outputs received at the parity circuit means inputs and for producing an output signal which blocks the data word detector circuit means and address detector circuit means from detecting data and address words when the evaluated parity differs from the first value.

7. A toy according to claim 1 in which the body has a second body part which is movable relative to the rest of the body, the toy including second drive means having an input coupled to the decoder circuit means for receiving the digital drive signals, the second drive means comprising means for moving the second body part in response to a predetermined digital combination of the drive signals.

8. A toy adapted for producing sound in response to audio signals recorded on a source and which moves in response to data signals on the source, comprising:

a body;

player mans mounted to the body and having an audio channel and a data channel, the player means comprising means for playing audio signals from the source on the audio channel and for playing data signals from the source on the data channel;

speaker circuit means in the body and coupled to the audio channel for receiving the audio signals and producing sound in response to the audio signals;

the body having a first body part which is movable relative to the rest of the body;

decoder circuit means coupled to the data channel for receiving the data signals and for producing an output of drive signals in response to the data signals;

first drive means having an input coupled to the decoder circuit means for receiving the drive signals, the first drive means comprising means for moving the first body part in response to the drive signals; and in which the decoder circuit means includes means for detecting audio signals on the data channel and for blocking the operation of the first drive means upon the detection of such audio signals.

9. A toy adapted for producing sound and moving in response to audio and data signals on respective audio and data channels from a source of such signals, comprising:

a body;

audio circuit means within the body and coupled to the audio channel for receiving the audio signals and producing sound in response to the received audio signals;

the body having at least one body part which is movable relative to the rest of the body;

decoder circuit means coupled to the data channel for receiving the data signals and decoding at least portions of data words or predetermined bit length encoded into the data signals, and for producing an output of digital drive signals in response to the data words of the data signals; and first drive means having an input coupled to the decoder circuit means for receiving the digital drive signals and for moving the first body part in response to the digital drive signals.

10. A toy according to claim 9 wherein the first drive means moves the one body part in response to the drive signals without feedback.

11. A toy according to claim 10 wherein the first drive means comprises an electric motor coupled with the first body part and means for reversibly driving the electric motor in response to the drive signals.

12. A toy according to claim 11 wherein the drive signals produced by the decoder circuit means and received by the first drive means are bi-level signals provided simultaneously on plural channels between the decoder circuit means and the first drive means.

13. A toy according to claim 12 in which the decoder circuit means further decodes address words encoded into the data signals and produces the drive signals in response to selected data words of the data signals identified by the address words.

14. A toy according to claim 9 wherein the first drive means comprises an electric motor coupled with the first body part and means for reversibly driving the electric motor in response to the drive signals.

15. A toy according to claim 9 wherein the drive signals produced by the decoder circuit means and received by the first drive means are bi-level signals provided simultaneously on plural channels between the decoder circuit means and the first drive means.

16. A toy according to claim 9 in which the decoder circuit means further decodes address words encoded into the data signals and produces the drive signals in response to selected data words of the data signals identified by the address words.

* * * * *